US006526663B1

(12) United States Patent
Simmons et al.

(10) Patent No.: US 6,526,663 B1
(45) Date of Patent: Mar. 4, 2003

(54) DETACHABLE COMB-AND-SHEERS APPARATUS

(76) Inventors: Timothy Keen Simmons, 1014 Rollingwood La., Goshen, KY (US) 40028; Craig A. Mueller, 156 Totem Rd., Louisville, KY (US) 40207; Wes Koch, 3910 Knable Ct., Floyds Knobs, IN (US) 47119; Steven M. Prentice, 1020 Woodmont Dr., New Albany, IN (US) 47150

( * ) Notice: Subject to any disclaimer, the term of this patent is extended or adjusted under 35 U.S.C. 154(b) by 0 days.

(21) Appl. No.: 09/873,831

(22) Filed: Jun. 2, 2001

Related U.S. Application Data

(60) Provisional application No. 60/209,575, filed on Jun. 6, 2000.

(51) Int. Cl.[7] ..... B26B 13/22
(52) U.S. Cl. ..... 30/233.5; 30/195
(58) Field of Search ..... 30/233.5, 195; 132/213.1

(56) References Cited

U.S. PATENT DOCUMENTS

| | | | | |
|---|---|---|---|---|
| 628,722 | A | | 7/1899 | McCarter |
| 698,195 | A | | 4/1902 | Henderson |
| 1,294,998 | A | | 2/1919 | Billy |
| 1,440,015 | A | | 11/1922 | Kaniefski |
| 1,466,193 | A | | 8/1923 | Schuster |
| 1,470,417 | A | | 10/1923 | Wintle |
| 1,783,583 | A | | 12/1930 | Ralston |
| 1,806,486 | A | | 5/1931 | Mirafuentes |
| 2,696,043 | A | * | 12/1954 | Maze ..... 30/233.5 |
| 4,660,285 | A | | 4/1987 | Pracht |
| D303,919 | S | | 10/1989 | Pate |
| D314,248 | S | | 1/1991 | Jobinen |
| D333,764 | S | | 3/1993 | Psva |
| 5,259,114 | A | | 11/1993 | Shorter |
| D407,527 | S | | 3/1999 | Bellisario |

* cited by examiner

*Primary Examiner*—Douglas D. Watts
(74) *Attorney, Agent, or Firm*—Charles G. Lamb; Middleton Reutlinger

(57) ABSTRACT

A tonsorial device is provided that includes a comb releasably attached to a pair of shears. This tonsorial device allows the user to employ a one handed method of cutting hair. The attachment mechanism includes a nut having a polymeric core and a metallic casing. The nut may be hand tightened to provide easy adjustment of the device. The comb provided includes a channel, which receives one blade of the shears, and a notch which receives the collar of the nut. The comb-and-shears apparatus allows for the efficient attachment and detachment of a comb from a pair of shears.

8 Claims, 5 Drawing Sheets

DETACHABLE COMB-AND-SHEERS APPARATUS

CROSS REFERENCE TO RELATED APPLICATIONS

This is a utility patent application claiming priority of Provisional Patent Application No. 60/209,575 filed Jun. 6, 2000.

BACKGROUND OF THE INVENTION

1. Field of the Invention

This invention relates generally to tonsorial devices. More particularly, the present invention relates to shears having a detachable comb and the attachment mechanism thereof.

2. Description of the Related Art

Hairstylists and barbers currently use a method for cutting hair in which a pair of shears is held in one hand, while a comb is passed back and forth between hands. The comb is held in the dominant hand to comb the hair and then transferred to the other hand before a cut is made. The transfer of the comb between hands may be repeated scores of times within a single haircut, thereby increasing the time to complete the task and the stress on the stylist's upper limbs and neck. The repetition of this transfer during the course of a stylist's career results in a decrease in efficiency and an increase in the likelihood of injury arising from repetitive stress.

Tonsorial tools comprising a pair of shears in combination with a comb are known in the art. Current devices generally include a pair of shears with a comb integrally formed therewith. In such devices, comb teeth extend from the spine of one or both blades of a pair of shears. However, these devices carry inherent disadvantages that outweigh those of the current method of cutting hair. One of the most significant disadvantages is that, since the comb portion is integrally formed with the shears portion of these devices, each requires sanitizing of the whole device, instead of only the comb portion thereof. Another disadvantage lies in the limited versatility of the one set of comb teeth present on a single device. In order to use a different type of comb with a given pair of shears, multiple complete tools must be purchased having different comb portions, thereby increasing the expense of using such devices.

Other devices are known in the art that theoretically overcome these disadvantages, but fail to do so in a manner efficient enough for them to actually be used frequently. For example, U.S. Pat. No. 1,806,486 to Mirafuentes discloses a pair of hair cutting shears having a removable comb attached thereto. This device may overcome the two disadvantages set forth above regarding integrally formed comb-and-shears devices, but the mechanism by which the comb is attached to the shears is too cumbersome to be useful to a hairstylist in practice. The mechanism disclosed for attaching the comb to the shears includes two threaded screws which attach the comb to one blade of the shears. As shown in the figures, the screws seem to require manipulation by a tool, such as a screwdriver, thereby making the device an impractical means for overcoming the aforementioned disadvantages in an efficient manner.

It is therefore desirable to provide a tonsorial device including a comb-and-shears apparatus by which the cutting and combing device may be held with one hand. It is also desirable that such a device allows for the quick and efficient removal of the comb portion from the shears portion, while allowing a variety of types of shears to be used with a variety of combs.

SUMMARY OF THE INVENTION

It is an object of the present invention to provide shears for cutting hair that includes a detachable comb portion therewith.

It is another object of the present invention to provide a tool-less attachment mechanism by which a comb portion may be releasably attached to a pair of shears.

It is a further object of the present invention to provide a comb that may be releasably attached to a pair of shears.

More particularly, the present invention is directed to a tonsorial device that includes a comb releasably attached to a pair of shears. The attachment mechanism includes a nut having a polymeric core enclosed in a metallic casing. The nut is threadably attached to the pivot screw that is disposed through apertures in both blades of the shears. The screw is threaded through the polymeric core of the nut. The polymeric core provides a greater friction coefficient than would be available with a conventional metallic nut, thereby preventing the nut from backing off the pivot screw. The comb includes a notch located in the proximal end of the comb, which receives the collar of the nut. The comb also includes a channel disposed along the spine thereof, whereby one blade of a pair of shears is received by the comb. The comb may be attached to a pair of shears by sliding the blade of the shears into the channel and sliding the nut into the notch included therein. In this manner, a variety of combs may be interchangeably attached to a pair of shears.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 1:
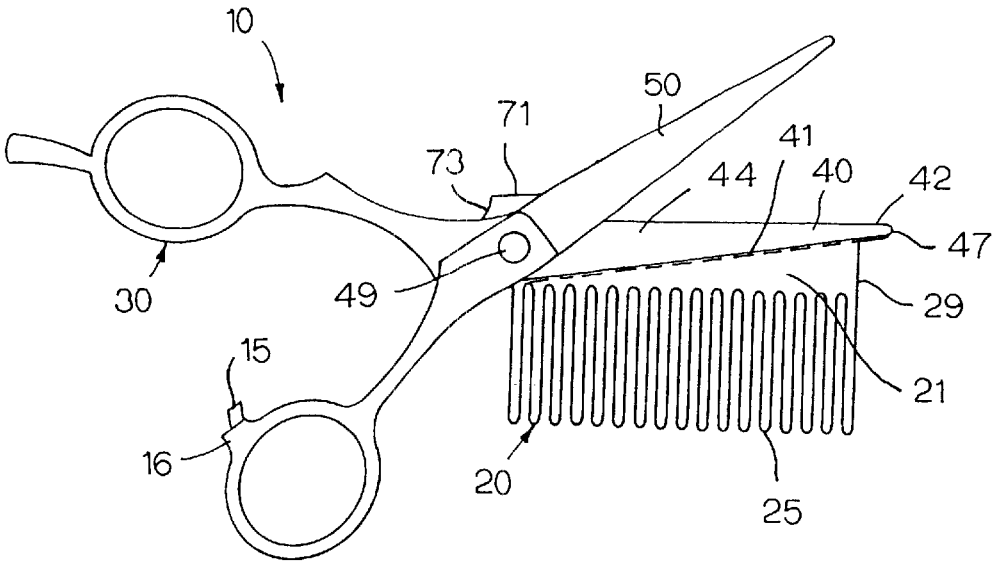
FIG. 1 is a front view of a comb-and-shears device of the present invention.
Figure 2:
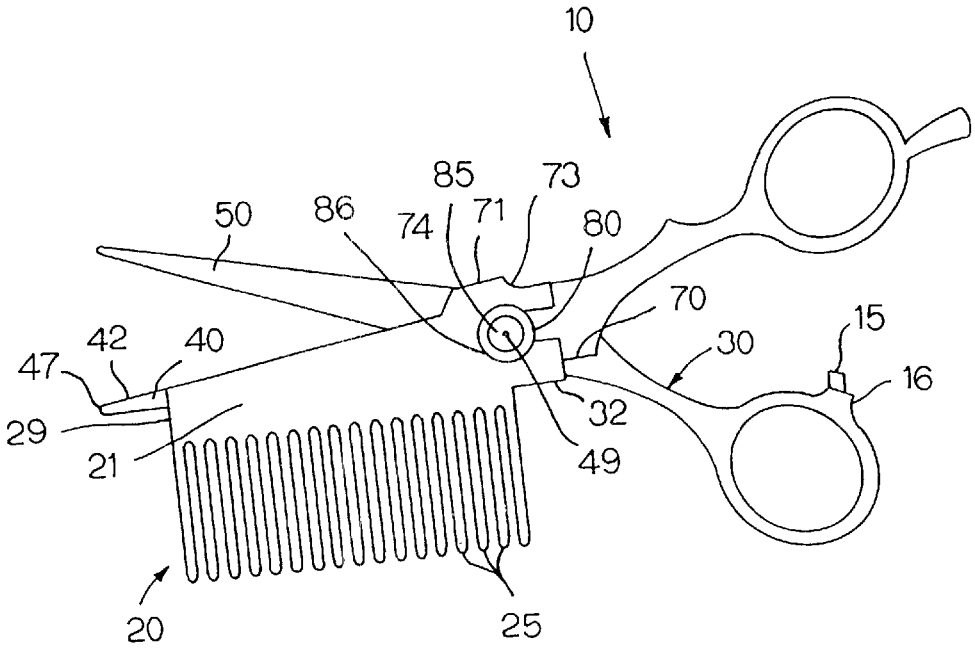
FIG. 2 is a back view of the comb-and-shears device of FIG. 1.

As shown in the figures, a comb-and-shears apparatus 10 includes a comb 20 releasably attached to a pair of shears 30. As shown in FIGS. 1 and 2, the comb 20 is disposed along a first blade 40 of the pair of shears 30. A nut 80 fastens the comb 20 to the shears 30. Nut 80 also works in conjunction with screw 49 to fasten the first blade 40 and second blade 50 of shears 30 together. When the comb 20 is attached to the shears 30, a plurality of teeth 25 of the comb 20 project outwardly from the spine 41 of the first blade 40 away from the cutting edge 42 of the first blade 40.

Figure 3:
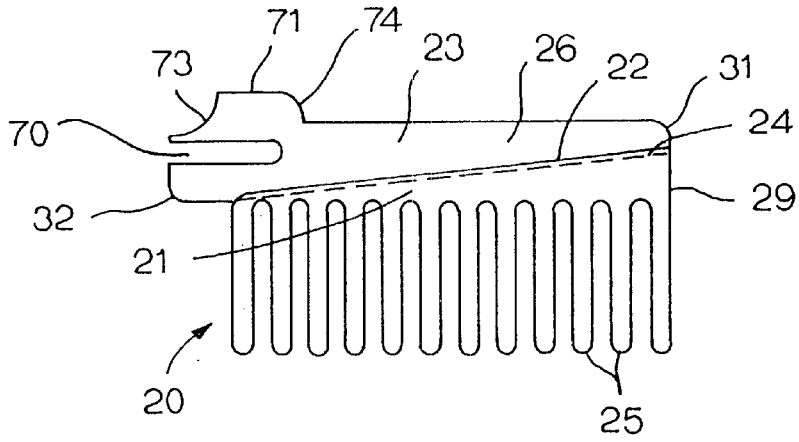
FIG. 3 is a front view of a comb of the present invention.
Figure 4:
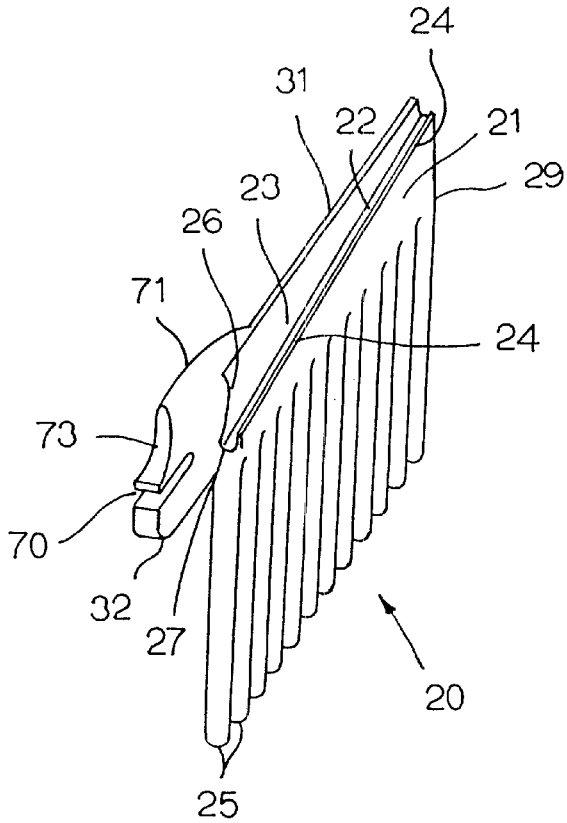
FIG. 4 is a perspective view of the comb of FIG.3.

As shown in FIG. 3, the comb 20 has a plurality of teeth 25 projecting from a spine 21 thereof. Teeth 25 may be any number, size and shape well known in the art useful for combing hair. The spine 21 includes a channel 22 for receiving the first blade 40 of a pair of shears 30. The channel 22 includes a first side wall 23 and a second side wall 24. In a preferred embodiment, the first side wall 23 includes a partially concave inner surface 26 as shown in FIG. 4, which engages the outer edge surface 41 of first blade 40. The second side wall 24 is generally shorter than first side wall 23. Second side wall 24 receives the inner surface 44 of first blade 40. In a preferred embodiment, side wall 24 rises from the base 27 of channel 22 approximately 1–2 mm, so that, when the first blade 40 of a pair of shears 30 is received in channel 22, the blades 40 and 50 of shears 30 may close completely without interference from side wall 24.

Figure 12:
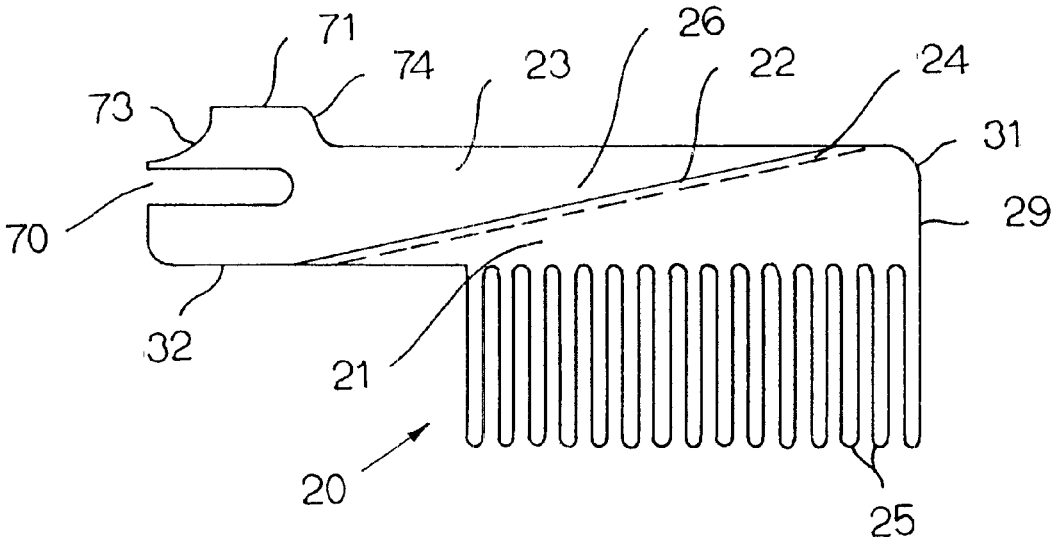
FIG. 12 is a front view of another embodiment of the comb of the present invention.
Figure 14:
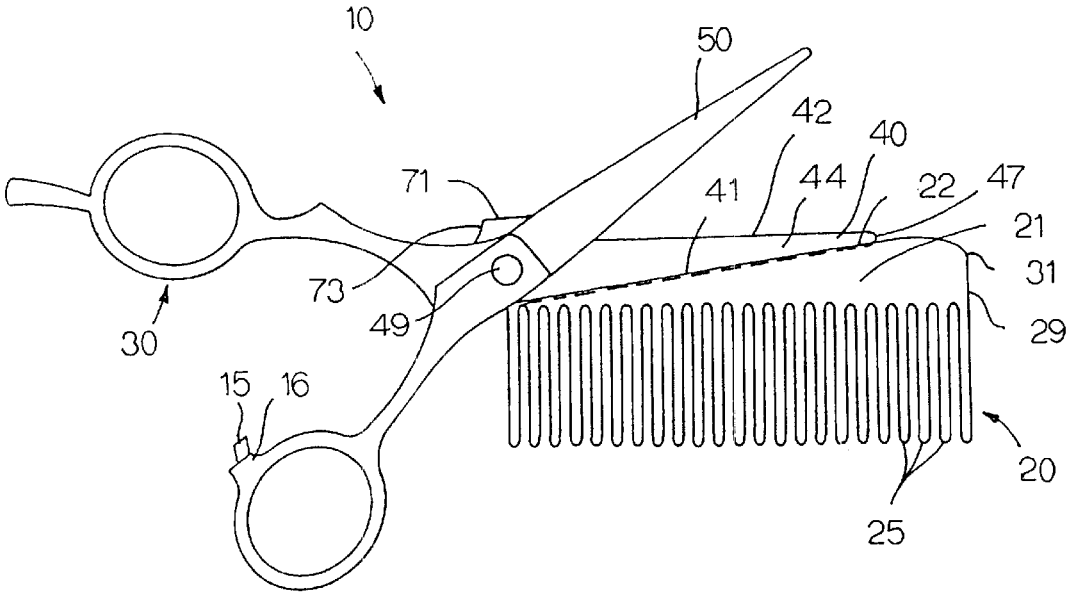
FIG. 14 is a front view of another embodiment of the comb-and-shears device of the present invention.

As shown in FIGS. 3 and 4, the base 27 of channel 22 is disposed at an angle to the tips of teeth 25 of comb 20. Channel 22 may extend either to the distal end 29 of comb 20, shown in FIGS. 1–4, or to the edge 31 of the spine 21 of comb 20, as shown in FIGS. 12 and 14.

As shown in FIGS. 2–4, comb 20 also includes a notch 70 disposed in the proximal end 32 of comb 20. Notch 70 receives the collar 89 of nut 80 when the comb 20 is attached to a pair of shears 30. Notch 70 may be U-shaped or any other convenient shape capable of receiving the collar 89 of nut 80.

Figure 5:
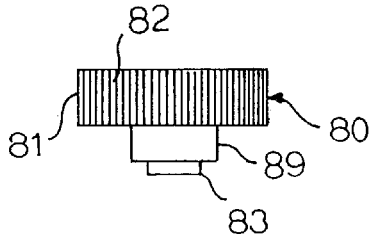
FIG. 5 is a side view of a nut of the present invention.
Figure 6:
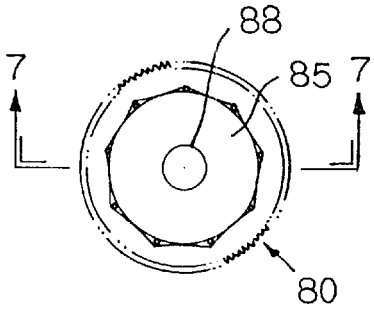
FIG. 6 is a top view of the nut of FIG. 5.

Also shown in FIGS. 4 and 5, comb 20 may include a tab 71 projecting outwardly from spine 21 away from teeth 25. As the comb 20 is attached or removed from a pair of shears 30, the user may apply force to one side or the other of tab 71 to aid in the task. In a preferred embodiment, tab 71 includes a concave side 73 and a convex side 74 that provide convenient surfaces to which force may be applied in the attaching or detaching of a comb 20 to a pair of shears 30.

As shown in FIG. 2, nut 80 is attached at the pivot point of fist blade 40 and second blade 46 of shears 30. Nut 80 is threadably attached to a screw 49, shown in FIG. 1, disposed through an aperture in each blade 40 and 46 of shears 30. Nut 80, in cooperation with screw 49, both fastens blades 40 and 46 together and provides sufficient tension to the blades to allow for efficient cutting with shears 30. Nut 80 also serves as the means by which a comb 20 may be securely fastened to shears 30. As shown in FIG. 5, nut 80 includes a circular head 81 from which depends a collar 89. The circular head 81 is beveled along the circumferential surface 82 thereof. This beveled surface 82 allows for the easy turning of the nut with only the user's hand, thereby eliminating the need for a tool to adjust the fastening mechanism. Nut 80 is further provided with a collar 89 which extends outwardly therefrom. Collar 89 has a terminating end 83 of a reduced diameter.

Figure 7:
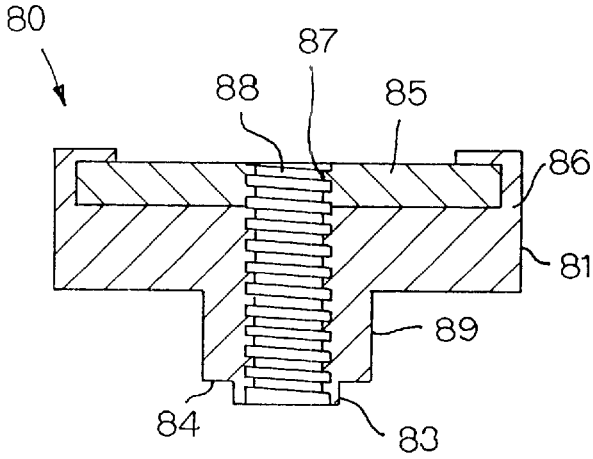
FIG. 7 is an enlarged cross-sectional view of the nut of FIG. 5 taken along line 7—7 of FIG. 6.

As shown in FIG. 7, nut 80 includes a polymeric core 85 partially enclosed in a metallic casing 86. The nut 80 has at least one thread 87 disposed along the inner surface of axial opening 88. Thread 87 runs through both the polymeric core 85 and the metallic casing 86. Thread 87 engages a thread disposed on the outer surface of screw 49, so as to fasten the two blades of shears 30. The polymeric core 85 may be formed of any polymer, well known in the art, that provides sufficient friction between the thread 87 and the thread of the screw 49. Also, the polymeric core 85 may extend through the entire length of nut 80, or a portion thereof as shown in FIG. 7. In a preferred embodiment, the polymeric core 85 is formed of nylon, while the metallic casing 86 is formed of brass.

Figure 8:
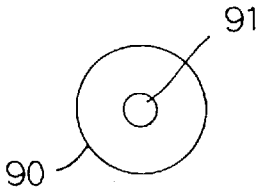
FIG. 8 is a top view of a washer of the present invention.
Figure 9:
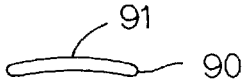
FIG. 9 is an edge view of the washer of FIG. 8.

As shown in FIGS. 8 and 9, a washer 90 is also included in the fastening mechanism of the present invention. In a preferred embodiment shown in FIG. 9, washer 90 is concave and partially deformable. More particularly, the center of washer 90 may flex relative to the outer edge thereof. Such a washer 90 is commonly known as a Belleville washer. When the two blades of shears 30 are fastened together, washer 90 is disposed on the shaft of screw 49. Nut 80 is then threadably attached to screw 49 and tightened down upon washer 90. Washer 90 is then aligned between the bottom surface 84 of collar 89 of nut 80 and the outer surface of first blade 40, with the terminating end 83 disposed through opening 91 of washer 90. The concave surface of washer 90 is then facing the outer surface of blade 40 of shears 30. Therefore, when nut 80 is threadably tightened, washer 90 will tend to flex downwards toward the outer face of first blade 40. In this manner, nut 80 may be threadably adjusted, while constant pressure is still applied to the blades of shears 30 by the flexing tension of washer 90.

Figure 10:
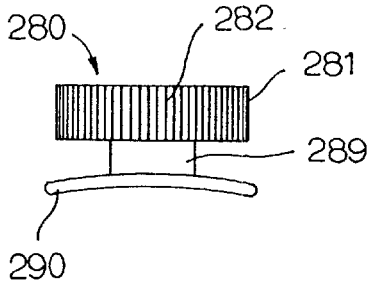
FIG. 10 is a side view of another embodiment of the nut of the present invention.

In another preferred embodiment shown in FIG. 10, nut 280 includes a washer 290 integrally formed thereto. The washer 290 is disposed at the lower edge of collar 289. As with the first embodiment shown in FIGS. 8 and 9, washer 290 is concave and provides constant securing pressure to the first blade 42 of shears 30 when washer 290 is flexed, thereby allowing for the threadable adjustment of nut 80 while maintaining the tension between the blades of shears 30.

Figure 11:
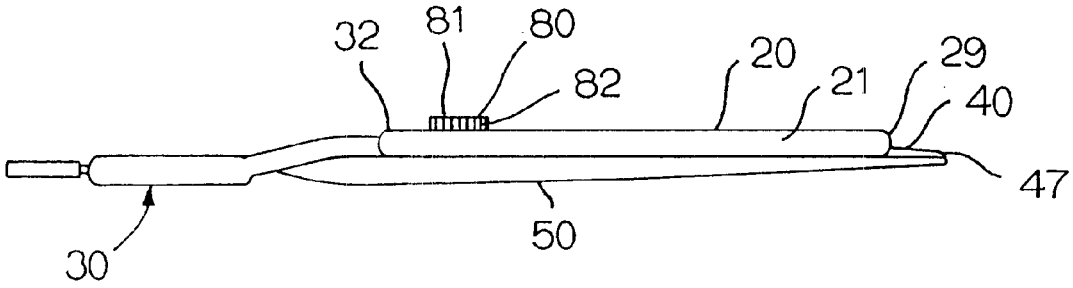
FIG. 11 is a top view of the comb-and-shears device of FIG. 2.

As shown in FIG. 11, the spine 21 of comb 20 is aligned along a portion of the length of first blade 40 of shears 30. In a preferred embodiment, the distal end 47 of first blade 42 extends beyond the distal end 29 of comb 20. The spine 21 of comb 20 is disposed between the outer surface of first blade 40 and nut 60 when comb 20 is attached to shears 30. The circular head 81extends beyond the sides of notch 70 to contact the outer surface of spine 21. Due to the presence of polymeric core 85 within nut 80, nut 80 provides a lower profile, as shown in FIG. 11, than would otherwise be available with an all-metal nut. More particularly, polymeric core 85 provides a higher friction coefficient than would be provided by the same depth of metal. Therefore, the height of circular head 81 including a polymeric core 85 is shorter than the height of the head of an all-metal nut. Thus, the profile of the comb-and-shears device 10 is lower with nut 80.

Figure 13:
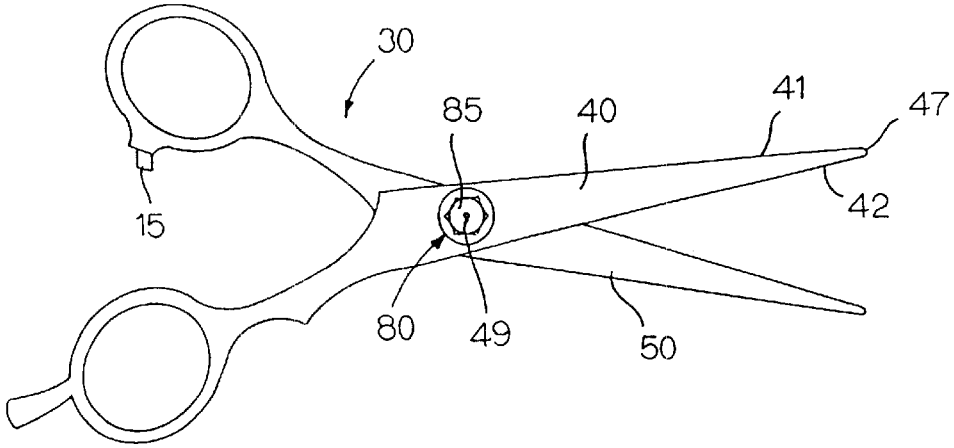
FIG. 13 is a back view of the shears of the present invention.

As shown in FIG. 13, shears 30 may also include a stop 15 attached to the loop of one of the blades thereof. Stop 15 may project from a base 16 integrally formed within the outer surface of a loop. Stop 15 may be formed of a metal or a polymer. In a preferred embodiment, stop 15 is formed of brass. In another preferred embodiment, stop 15 is formed of rubber. In each case, stop 15 projects from an outer edge of a loop such that, when shears 30 are closed, stop 15 contacts the loop of the other blade. In this manner, the blades of shears 30 are prevented from over closing. More particularly, stop 15 allows the sharpened ends of the blades to stop at a predetermined position relative to each other, when the shears are closed.

The foregoing detailed description of the preferred embodiments of the present invention are given primarily for clearness of understanding and no unnecessary limitations are to be understood therefrom for modifications will become obvious to those skilled in the art upon reading the disclosure and may be made without departing from the spirit and scope of the invention.

What is claimed is:

1. A tonsorial device comprising:

a pair of shears, each shear having a handle and a cutting blade;

a pivot assembly pivotally attaching said shears at a preselected location between said handles and said cutting blades, each said shear having an aperture at said preselected location, said pivot assembly having a pivot screw extending through said apertures and a nut threadably attached to said screw; and, a comb detachably connected to said pair of shears at said preselected location, said comb having a notch in a proximal end of said comb, said notch receiving a collar of said nut, said comb having a channel disposed along a spine of said comb, said channel receiving an outer edge of one of said blades.

2. The device of claim 1, said nut having a polymeric threaded core.

3. The device of claim 2, said polymeric core being a nylon and the nut being brass.

4. The device of claim 1, said channel including a first side wall and a second side wall, said first side wall including a partially concave inner surface engagable with the outer edge of said one of said blades.

5. The device of claim 1, said comb including a plurality of teeth projecting outwardly from an outer edge of one of said blades away from an inner cutting edge of one of said blades.

6. The device of claim 5, said comb including a tab projecting outwardly from a spine, away from said teeth.

7. The device of claim 6, said tab including a concave side and a convex side.

8. A tonsorial device comprising:

a pair of shears, each shear having a handle and a cutting blade, each cutting blade having an outer edge and an inner cutting edge;

a pivot assembly pivotally attaching said shears wherein said inner cutting edges are in face-to-face relation, said pivot assembly having a pivot screw extending through aligned apertures of said shears, said apertures being at a preselected location between said handles and said cutting blades with a nut threadably attached to said screw; and, a comb having a notch in a proximal end of said comb, said notch receiving a collar of said nut and detachably connected to said pair of shears at said preselected location, said comb having a channel disposed along a spine of said comb, said channel receiving an outer edge of one of said blades.

* * * * *